US010954965B2

(12) United States Patent
Bailey

(10) Patent No.: US 10,954,965 B2
(45) Date of Patent: Mar. 23, 2021

(54) FAN MOUNT

(71) Applicant: Dish Technologies L.L.C., Englewood, CO (US)

(72) Inventor: Matthew Paul Bailey, Centennial, CO (US)

(73) Assignee: DISH Technologies L.L.C., Englewood, CO (US)

( * ) Notice: Subject to any disclaimer, the term of this patent is extended or adjusted under 35 U.S.C. 154(b) by 658 days.

(21) Appl. No.: 15/236,773

(22) Filed: Aug. 15, 2016

(65) Prior Publication Data

US 2018/0045223 A1 Feb. 15, 2018

(51) Int. Cl.
*F04D 29/66* (2006.01)
*F04D 29/60* (2006.01)

(52) U.S. Cl.
CPC ..... *F04D 29/668* (2013.01); *F04D 29/601* (2013.01)

(58) Field of Classification Search
CPC .... F04D 29/601; F04D 29/668; F04D 29/646; H05K 7/20172; H05K 7/20136; H05K 7/20727
USPC ..... 361/679.48, 695; 248/636, 638; 454/184; 312/236; 415/119
See application file for complete search history.

(56) References Cited

U.S. PATENT DOCUMENTS 4,598,894 A * 7/1986 Johannes ..... F04D 29/601 248/222.11
5,275,221 A * 1/1994 Doehlemann ..... E04F 10/02 160/84.04
6,328,529 B1 * 12/2001 Yamaguchi ..... F04D 29/582 257/E23.086
8,371,805 B2 * 2/2013 Peng ..... F04D 19/007 415/119
8,800,951 B2 * 8/2014 Sun ..... G06F 1/20 248/200
2007/0003419 A1 * 1/2007 Wu ..... F04D 29/601 417/363
2008/0302622 A1 * 12/2008 Ohtake ..... F16F 1/371 188/379
2010/0129235 A1 * 5/2010 Qian ..... F04D 25/0613 417/363
2013/0045109 A1 * 2/2013 Lee ..... F04D 19/007 416/244 R
2016/0298653 A1 * 10/2016 Masuo ..... F04D 29/668

FOREIGN PATENT DOCUMENTS

CN 205075615 U * 3/2016

OTHER PUBLICATIONS

"CN205075615U Machine Translation", Mar. 2016, Obtained from: Espacenet. (Year: 2016).*

* cited by examiner

*Primary Examiner* — Courtney D Heinle
*Assistant Examiner* — Elton K Wong
(74) *Attorney, Agent, or Firm* — Perkins Coie LLP

(57) ABSTRACT

A computing device fan mounting system includes a chassis, a fan housing, and a fan mount. The chassis includes a receiving opening. The fan housing defines a first opening and a second opening. The fan mount includes a first peg engaged with the first opening, a second peg engaged with the second opening, and a pin engaged with the receiving opening.

20 Claims, 3 Drawing Sheets

FAN MOUNT

BACKGROUND

Computing devices such as set top boxes typically include a fan to cool components. The fan is secured to a chassis of the set top box. Specifically, the fan includes openings that are individually secured to a respective opening in the chassis, requiring several securing components that consume limited space in the set top box. Furthermore, as the fan rotates, the fan vibrates and transfers vibrations to the chassis.

DETAILED DESCRIPTION

A fan mount secures a fan to a chassis of a computing device such as a set top box, a laptop computer, a desktop computer, or the like. The computing device may include components that require cooling during operation, e.g., a processor, a hard disk drive, a graphics processing unit, etc. The fan provides cooling to the components. The components and the fan may be secured to the chassis with a mount, e.g., a fan mount, to position the fan to cool the components and to prevent movement of the components and the fan. The fan mount includes a pair of pegs that engage a fan housing and a pin that engages a receiving opening in the chassis, securing the fan to the chassis. The fan mount is constructed of a flexible material that absorbs and reduces vibrations caused by the fan. The fan housing may include four openings, and each peg may engage one of the openings, so two fan mounts may secure the fan to the chassis, reducing a number of components required for the computing device by reducing a number of components needed to secure the fan to the computing device.

Figure 1:
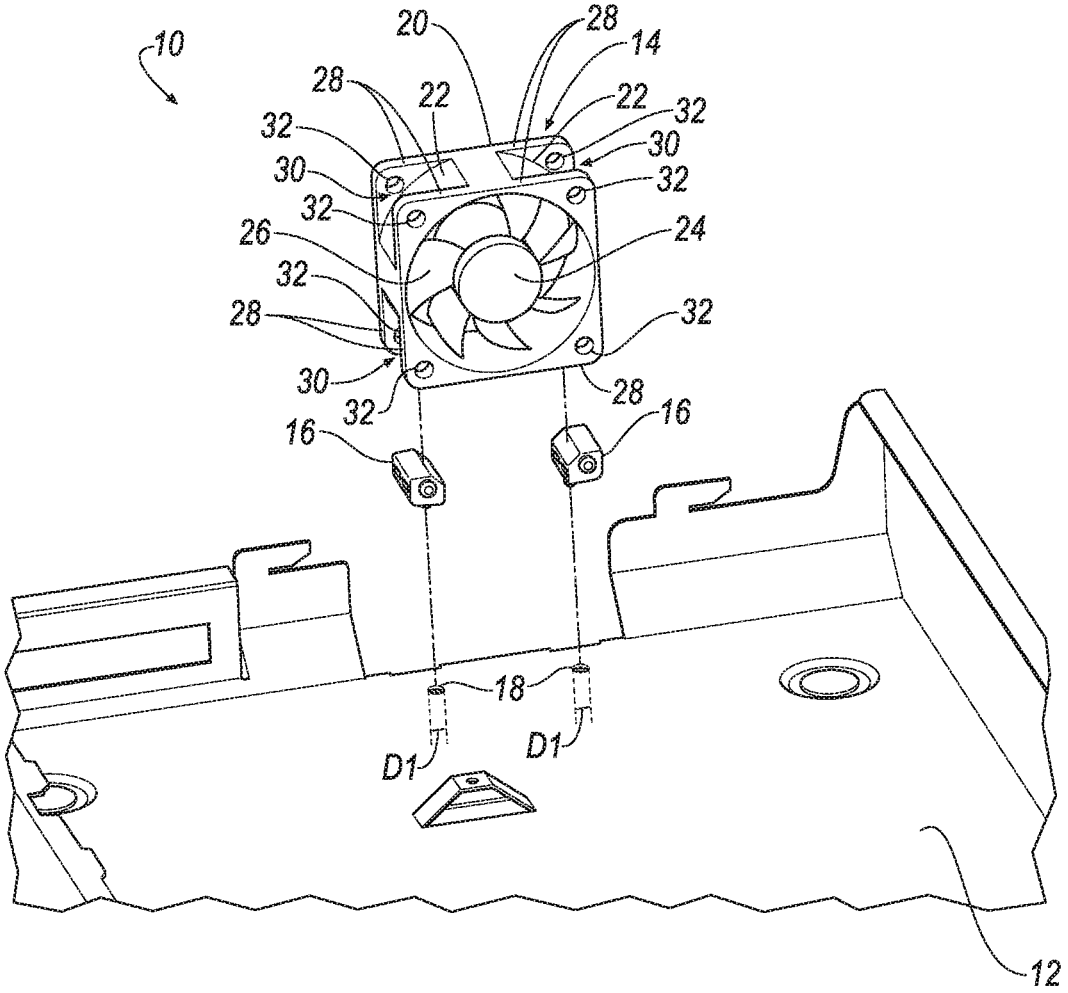
FIG. 1 is a perspective view of a set top box including an example fan mount.

FIG. 1 illustrates a portion of an example computing device. The example computing device of FIG. 1 is a set top box 10. The set top box 10 includes a chassis 12, a fan 14, and two fan mounts 16. The chassis 12 supports components of the set top box 10, e.g., the fan 14, the fan mounts 16, etc. The chassis 12 includes at least one receiving opening 18. The receiving opening 18 provides means for components of the set top box 10 to be secured to the chassis 12. The receiving opening 18 has a diameter D1. In the example of FIG. 1, the chassis 12 includes two receiving openings 18 arranged to receive two fan mounts 16 to secure the fan 14 to the chassis 12. Alternatively, the fan 14 may be secured to one of the receiving openings 18 with one fan mount 16 and secured to the other receiving opening 18 with a conventional fastener, e.g., a grommet.

The fan 14 includes a fan housing 20. The fan housing 20 includes a rotor housing 22. The rotor housing 22 houses a rotor 24 and a plurality of blades 26 attached to and/or formed with the rotor 24 in a known manner. The rotor 24 rotatable connects the blades 26 to the rotor housing 22, allowing the blades 26 to rotate and propel air into the set top box 10. The rotor 24 may include a motor (not shown) that rotates the blades 26. The rotation of the rotor 24 produces vibrations that are transferred to the rotor housing 22 and to the chassis 12. The rotor housing 22 may be substantially circular.

The fan housing 20 may include at least one pair of walls 28 extending from the rotor housing 22. The walls 28 are spaced from each other, i.e., define a gap 30 therebetween. The gap (also sometimes referred to as a mount opening) 30 between the walls 28 provides a location to mount the fan 14 to the chassis 12. The fan mount 16 may be shaped to fit within the mount opening 30. That is, the fan mount 16, except for pegs 34 discussed below, may be dimensioned to frictionally engage, and/or not to extend beyond, inner surfaces of the walls 28. The fan 14 of FIG. 1 includes four pairs of walls 28 defining four mount openings 30, and two fan mounts 16 may be inserted into two of the mount openings 30 and engage two pairs of walls 28. The walls 28 may be substantially triangular such that the four pairs of walls 28 define four substantially straight edges, i.e., the fan housing 20 may have a substantially rectangular shape.

Each wall 28 includes an opening 32 to receive a fan mount 16 peg 34. The opening 32 engages the peg 34 of the fan mount 16, securing the fan mount 16 to the wall 28. The fan housing 20 of FIG. 1 includes eight openings 32 (seven are visible in FIG. 1), each of which may engage the fan mount 16. The fan 14 may be secured vertically relative to the chassis 12, which would arrange four of the eight openings 32 to engage the two fan mounts 16 and the receiving openings 18. Four openings 32 engage the two fan mounts 16; three of the openings 32 are visible in FIG. 1. The openings 32 as shown in FIG. 1 are substantially circular. Alternatively, the openings 32 may be a different shape, e.g., rectangular, elliptical, etc.

The fan mount 16 secures the fan 14 to the chassis 12. The fan mount 16 may absorb and dampen vibrations caused by the fan 14, reducing vibrations transferred to the chassis 12. The fan mount 16 may secure the fan 14 to the chassis 12 by connecting to the openings 32 in the walls 28 and to the receiving opening 18. That is, the fan mount 16 may be connected to two of the openings 32 and to one of the receiving openings 18. Thus, two fan mounts 16 (engaging four openings 32 and two receiving openings 18) may secure the fan 14 to the chassis 12.

Figure 2:
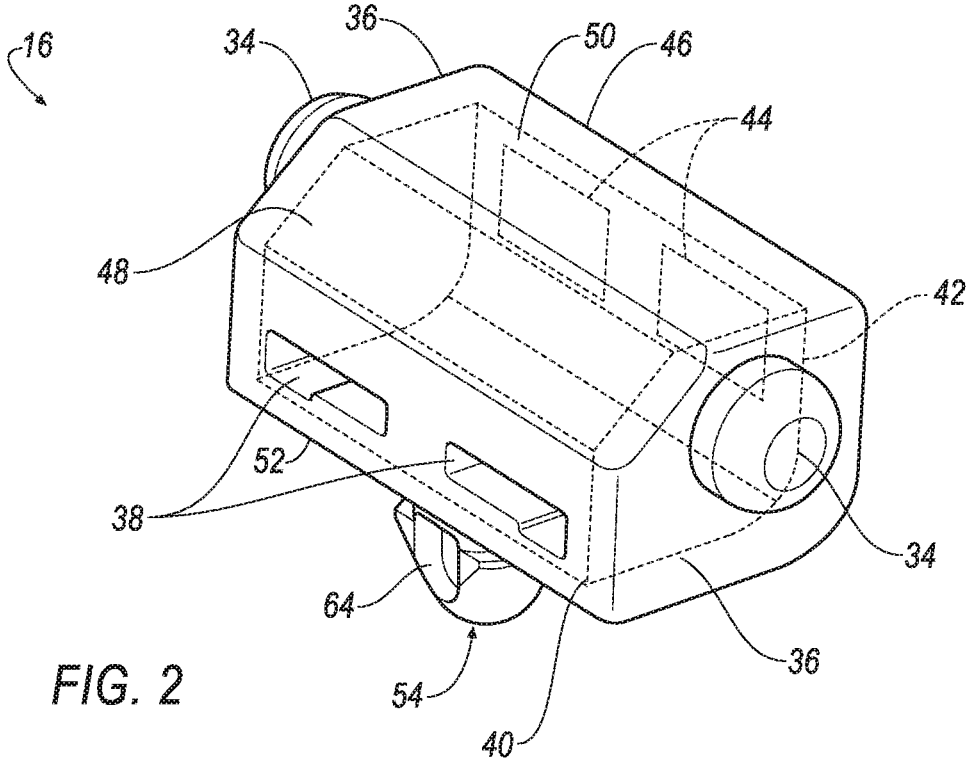
FIG. 2 is a front perspective view of the fan mount of FIG. 1.
Figure 3:
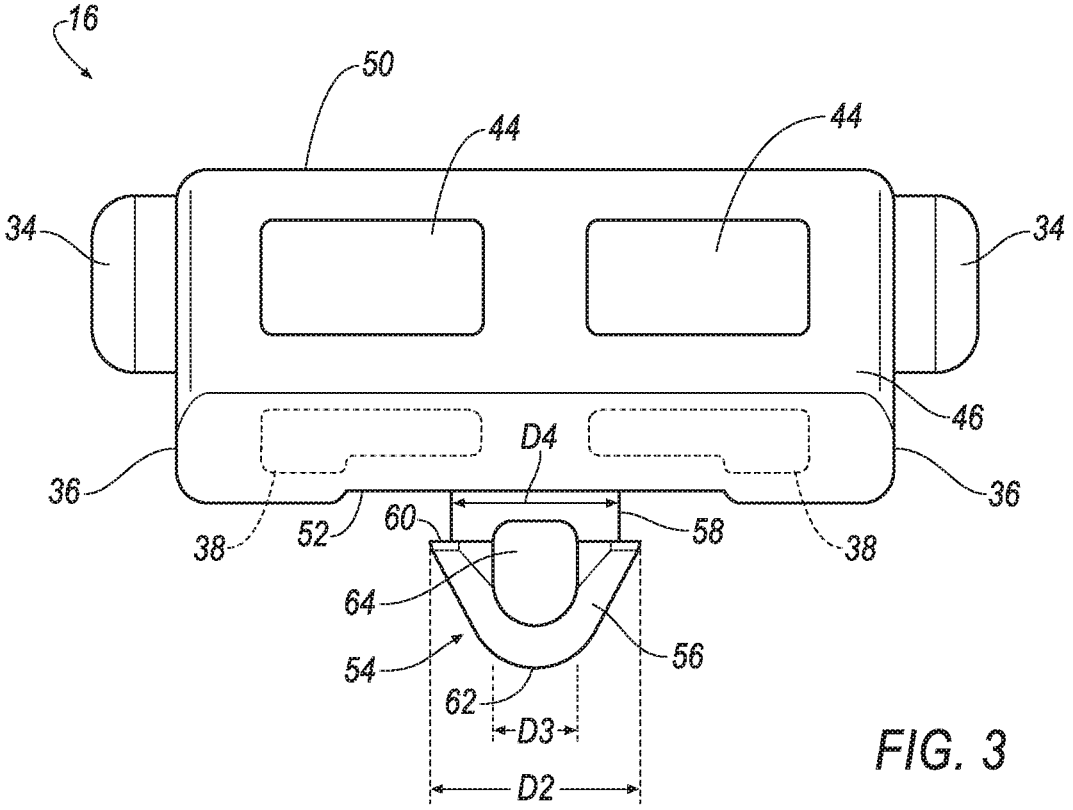
FIG. 3 is a rear view of the fan mount of FIG. 1.

FIGS. 2 and 3 illustrate an example fan mount 16. FIG. 2 illustrates a perspective view of the fan mount 16, and FIG. 3 illustrates a rear view of the fan mount 16. The fan mount 16 may be constructed of a flexible material, e.g., plastic, rubber, a composite, etc. The flexible material may allow the fan mount 16 to deform to a compressed position in which portions of the fan mount 16 compress to allow components to engage and disengage with the fan housing 20. The flexible material may have a friction coefficient that, when the fan mount 16 is in contact with the openings 32, secures or helps to secure the fan mount 16 to the fan housing 20, preventing disengagement of the fan mount 16 from the fan housing 20. That is, the fan mount 16 may engage the openings 32 with an interference fit, i.e., the contact between the fan mount 16 and the openings 32 produces friction that prevents disengagement of the fan mount 16 from the openings 32.

The flexible material may allow the fan mount 16 to return to the original shape of the fan mount 16 (i.e., an undeformed shape of the fan mount 16) when the force is released, allowing the fan mount 16 to be deformed more than one time. Furthermore, the flexible material may allow the fan mount 16 to absorb and dampen incoming vibrations, reducing the transfer of vibrations to components connected to the fan mount 16. For example, the fan mount 16 may be constructed of a flexible material that absorbs and dampens vibrations from the rotor 24 rotating the blades 26.

The fan mount 16 may include a pair of pegs 34. The pegs 34 may engage the openings 32 in the walls 28, holding the fan housing 20 in place. The pegs 34 may each extend from respective ends 36 of the fan mount 16. When the fan mount 16 is in the compressed position, the pegs 34 may disengage from the openings 32, moving the pegs 34 away from the openings 32 and disconnecting the fan 14 from the chassis 12. The pegs 34 as shown in FIG. 2 are substantially cylindrical, and the pegs 34 may be shaped to engage the openings 32, e.g., rectangular, elliptical, etc.

Figure 5:
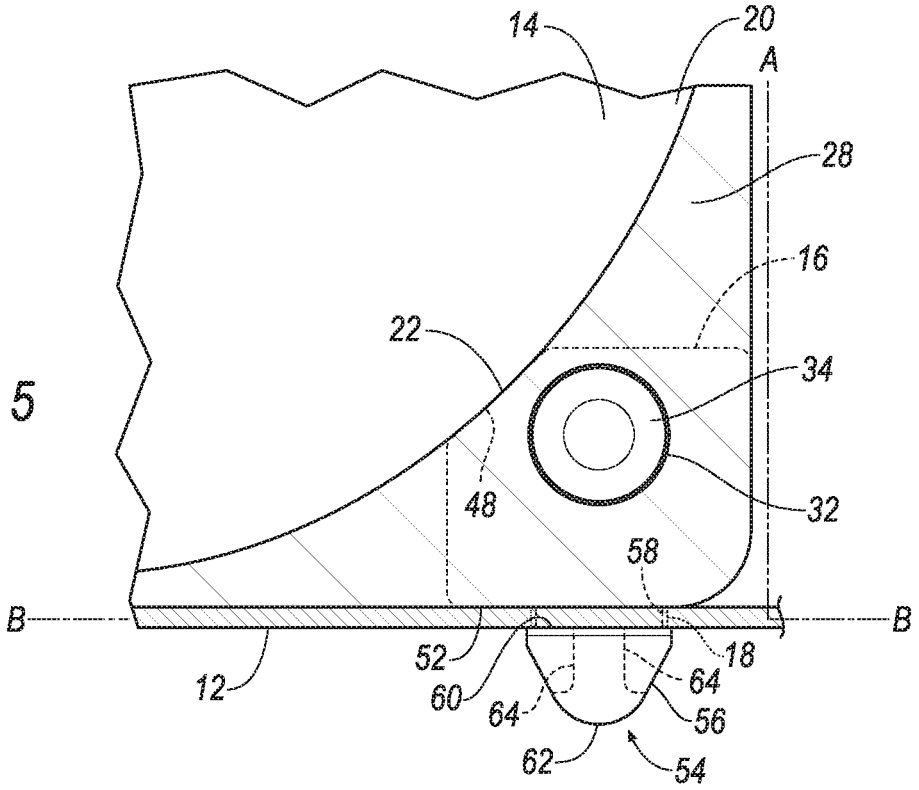
FIG. 5 is a sectional view of the set top box of FIG. 4.

The fan mount 16 may include an inclined side 48, i.e., the side 48 forms an obtuse angle with a front side 40 and a top side 50 of the fan mount 16. Because the rotor housing 22 may reduce space in the mount opening 30 for a substantially rectangular fan mount 16, the inclined side 48 allows the fan mount 16 to engage the fan housing 20 without extending beyond the mount opening 30. As shown in FIG. 5 and described below, the inclined side 48 may connect the front side 40 and the top side 50 of the fan mount 16 and contact the rotor housing 22, absorbing vibrations from the rotor housing 22 and reducing the vibrations transferred to the chassis 12.

The fan mount 16 may include at least one front port 38. The example fan mount 16 of FIGS. 2-3 shows two front ports 38. The front ports 38 may be disposed on the front side 40 of the fan mount 16. The front ports 38 connect to a cavity 42 of the fan mount 16, allowing the fan mount 16 to compress to the compressed position and allowing the air in the cavity 42 to exit through the front ports 38.

The fan mount 16 may include at least one rear port 44 connected to the cavity 42 and disposed on a rear side 46 of the base. The example fan mount 16 of FIGS. 2-3 includes two rear ports 44. The front ports 38 and the rear ports 44 allow air to exit the cavity 42 when the fan mount 16 is in the compressed position. That is, the front ports 38 and the rear ports 44 may be positioned on the fan mount 16 to move air away from the fan mount 16. For example, the rear side 46 of the fan mount 16 may face out of the mount opening 30, allowing air to exit from the cavity 42 through the rear ports 44 and away from the mount opening 30.

The cavity 42 may be sized to reduce the thickness of the fan mount 16, reducing the amount of force necessary to place the fan mount into the compressed position. That is, the cavity 42 may be configured to reduce the overall material required to construct the fan mount 16. Furthermore, the cavity 42 may be sized to allow the pegs 34 to disengage from the openings 32 when the fan mount 16 is in the compressed position. The cavity 42 may be shaped to substantially match the shape of the fan mount 16, as shown in FIG. 2. For example, the cavity 42 may be defined by the thickness of the fan mount 16, e.g., the thickness of the ends 36

The fan mount 16 includes a pin 54, as shown in FIGS. 2-3. The pin 54 may be attached to the bottom side 52 of the fan mount 16. The pin 54 engages the receiving opening 18 to secure the fan mount 16 to the chassis 12. Thus, when the pegs 34 are engaged with the openings 32 of the fan housing 20 and the pin 54 is engaged with the receiving opening 18, the fan mount 16 secures the fan to the chassis 12.

The pin 54 may include a conical portion 56 and a narrow (or stem) portion 58. The conical portion 56 tapers from a top portion 60 to a bottom portion 62, and the top portion 60 may have a diameter D2 greater than a diameter D3 of the bottom portion 62. The narrow portion 58 may connect the top portion 60 of the conical portion 56 to the bottom side 52 of the fan mount 16. The narrow portion 58 may have a diameter D4 that is smaller than the diameter D2 of the top portion 60. The conical portion 56 may be deformably insertable into the receiving opening 18, i.e., the conical portion 56 may at least partially deform from an undeformed state upon insertion into the receiving opening 18. Because the conical portion 56 is deformable, the diameter D2 of the conical portion 56 may be larger than the diameter D1 of the receiving opening 18 in the undeformed state, as shown in FIG. 4, preventing upward movement of the conical portion 56 through the receiving opening 18 after the pin 54 is inserted into the receiving opening 18.

The pin 54 may include a pin opening 64. The pin opening 64 may extend from the conical portion 56 to the narrow portion 58. The pin opening 64 allows the top portion 60 of the conical portion 56 to deform, allowing the pin 54 to fit through the receiving opening 18. That is, as described below and shown in FIGS. 4-5, the diameter D2 of the top portion. 60 may be larger than the diameter D1 of the receiving opening 18. Thus, to move the pin 54 through the receiving opening 18, the top portion 60 deforms at least partially into the pin opening 64, allowing the top portion 60 to fit through the receiving opening 18. When the top portion 60 moves completely through the receiving opening 18, the top portion 60 moves out of the pin opening 64 and returns to the undeformed state. When the top portion 60 is completely through the receiving opening 18, the pin 54 is fully inserted in the receiving opening 18. By allowing the top portion 60 to deform as the conical portion 56 is inserted into the receiving opening 18, the conical portion 56 is deformably insertable into the receiving opening 18. As shown in FIGS. 2-3, the pin 54 may include two pin openings 64 disposed on opposite sides of the pin 54.

The fan mount 16 can be placed into the compressed position. In the compressed position, the pegs 34 disengage from the openings 32, allowing a user to remove the fan 14 while the fan mount 16 remains connected to the chassis 12. The cavity 42 allows the ends 36 to deform upon application of a force. That is, when a force is applied to one of the ends 36, e.g., with pliers, the respective end 36 may deform and move toward the other end 36. Because the ends 36 move inwardly toward the cavity 42, the ends 36 pull the pegs 34 from the openings 32. Thus, applying the force to the ends 36 removes the pegs 34 from the openings 32, allowing the user to disengage the fan 14 from the fan mount 16. The top side 50, the inclined side 48, and the front side 40 stay also deform upon application of a force, allowing the fan mount 16 to compress in more than one orientation. In another example, applying a force to the inclined side 48 may move the inclined side 48 toward the bottom side 52, deforming the inclined side 48, the top side 50, and/or the front side 40.

Figure 4:
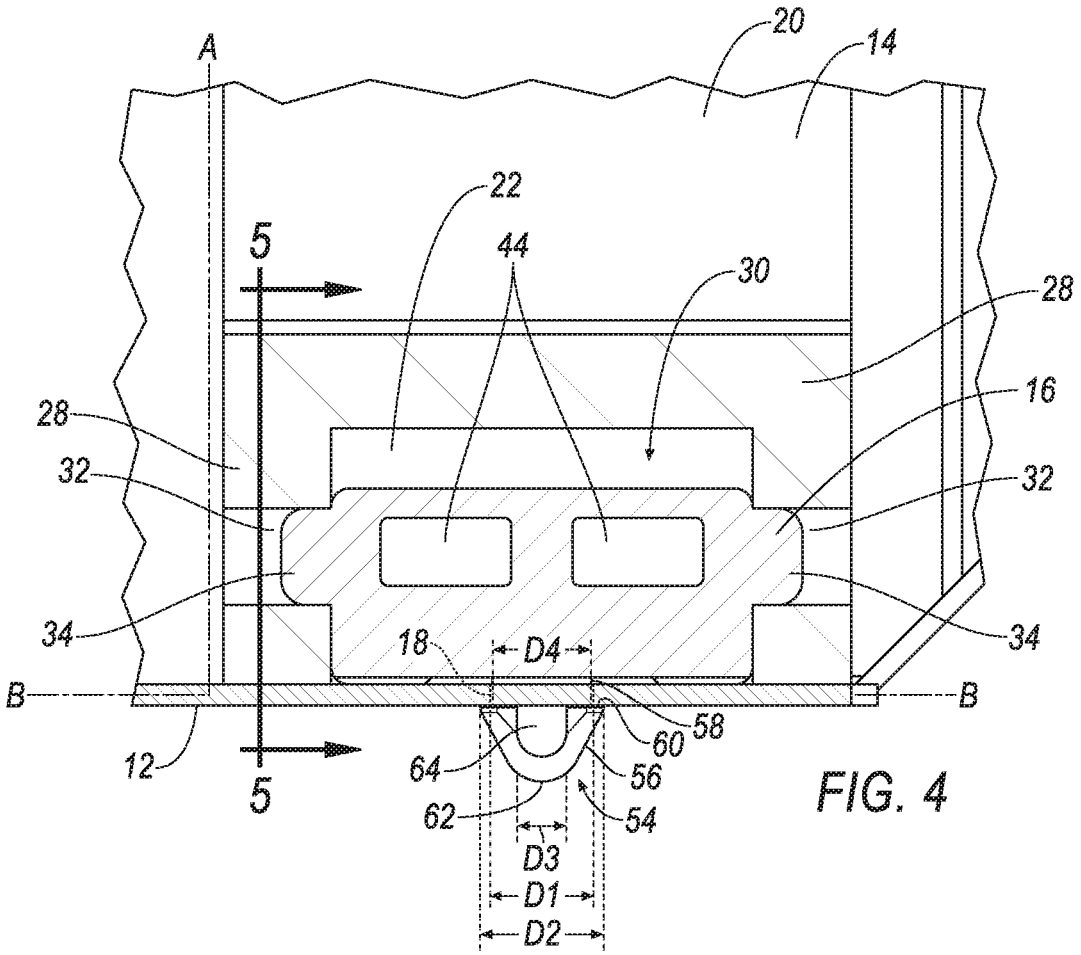
FIG. 4 is a side view of the set top box of FIG. 1 with the fan mount securing a fan to a chassis.

FIG. 4 illustrates the fan mount 16 connecting the fan 14 to the chassis 12. The fan mount 16 is secured to the fan 14 by engagement of the pegs 34 with the openings 32, securing the fan housing 20 to the fan mount 16. That is, each peg 34 is sized to contact an edge of the respective opening 32, providing an interference fit with the opening 32. Furthermore, the pegs 34 engage two of the openings 32, such that one fan mount 16 can engage two openings 32. That is, rather than using conventional mounts, e.g., grommets, to connect each of the four openings 32 with the chassis 12, which would require four conventional mounts, a user can connect two fan mounts 16 to secure the fan 14 to the chassis 12.

The fan mount 16 is connected to the chassis 12 via the pin 54. The pin 54 is fully inserted in the receiving opening 18. That is, the conical portion 56 is disposed beneath the receiving opening 18, and the narrow portion 58 is disposed in the receiving opening 18 connecting the conical portion 56 to the bottom side 52 of the fan mount 16. Thus, as described below, vertical movement of the fan 14 is reduced by contact between the conical portion 56 and the receiving opening 18.

As described above, the pin 54 is installed in the receiving opening 18. When the pin 54 is engaged with the receiving opening 18, the conical portion 56 is disposed beneath the receiving opening 18 and the narrow portion 58 is disposed in the receiving opening 18 between the bottom side 52 and the conical portion 56. The narrow portion 58 may have a diameter D4 smaller than the diameter D1 of the receiving opening 18 to fit within the receiving opening 18. Furthermore, the diameter D3 of the bottom portion 62 may be smaller than the diameter D1 of the receiving opening 18 to allow the conical portion 56 through the receiving opening 18, and the diameter D2 of the top portion 60 may be greater than the diameter D1 of the receiving opening 18 to vertically secure the fan mount 16. That is, the pin 54 may be constructed of a flexible material, e.g., plastic, rubber, a composite, etc., and the conical portion 56 may deform into the pin opening 64 as the pin 54 is inserted into the receiving opening 18, allowing the pin 54 to pass through the receiving opening 18. The top portion 60 may be substantially flat such that more force may be required to upwardly pull the pin 54 through the receiving opening 18 than to downwardly push the pin 54 through the receiving opening 18, preventing the conical portion 56 from moving up through the receiving opening 18. Thus, vertical movement of the pin 54 (and thus the fan mount 16 and the fan 14) may be reduced when the pin 54 is fully inserted into the receiving opening 18.

FIG. 5 illustrates a side view of the fan mount 16 of FIG. 4 along the line 5-5. The fan mount 16 is installed in the receiving opening 18 and connected to the fan housing 20. That is, FIG. 5 shows one of the pegs 34 engaging one of the openings 32 of one of the walls 28 and the pin 54 fully installed in the receiving opening 18.

As described above, the fan mount 16 includes the inclined side 48. As shown in FIG. 5, the inclined side 48 may contact the rotor housing 22. When the inclined side 48 contacts the rotor housing 22, the inclined side 48 may absorb vibrations caused by the rotation of the fan blades 26, reducing the vibration of the fan 14 and the vibrations transferred to the chassis 12. Alternatively, the inclined side 48 may be separated from the rotor housing 22 by a gap.

As shown in FIGS. 4-5, the bottom side 52 of the fan mount 16 contacts the chassis 12. The bottom side 52 transfers vibrations from the fan 14 to the chassis 12. Because the fan mount 16 may be constructed of a flexible material, e.g., rubber, plastic, etc., the bottom side 52 may absorb and dampen vibrations received from the fan 14, reducing the vibrations transferred to the chassis 12.

As shown in FIGS. 4-5, the fan mount 16 may secure the fan 14 substantially perpendicular to the chassis 12. That is, the fan 14 may define an axis A normal to a plane B of the chassis 12. The fan housing 20 may be substantially straight along the axis A, defining a substantial right angle with the plane B. By securing the fan 14 along the axis A, the openings 32 are arranged relative to the receiving opening 18 such that the fan mount 16 can engage the opening 32 and the receiving opening 18. The pegs 34 may be disposed substantially parallel to the plane B to engage the openings 32 in the fan housing 20, and the pin 54 may be substantially parallel to the axis A, i.e., in a vertical direction relative to the chassis 12, to engage the receiving opening 18 in the chassis 12.

As used herein, the adverb "substantially" modifying an adjective means that a shape, structure, measurement, value, calculation, etc. may deviate from an exact described geometry, distance, measurement, value, calculation, etc., because of imperfections in materials, machining, manufacturing, sensor measurements, computations, processing time, communications time, etc.

Accordingly, it is to be understood that the present disclosure, including the above description and the accompanying figures and below claims, is intended to be illustrative and not restrictive. Many embodiments and applications other than the examples provided would be apparent to those of skill in the art upon reading the above description. The scope of the invention should be determined, not with reference to the above description, but should instead be determined with reference to claims appended hereto and/or included in a non-provisional patent application based hereon, along with the full scope of equivalents to which such claims are entitled. It is anticipated and intended that future developments will occur in the arts discussed herein, and that the disclosed systems and methods will be incorporated into such future embodiments. In sum, it should be understood that the disclosed subject matter is capable of modification and variation.

The invention claimed is:

1. A computing device fan mounting system, comprising:

a chassis including a receiving opening;

a fan housing defining a first opening and a second opening; and a fan mount including a first peg engaged with the first opening, a second peg engaged with the second opening, and an enclosed compressible cavity within the fan mount, wherein the first peg is attached to a first end of the enclosed compressible cavity and the second peg is attached to a second end of the enclosed compressible cavity and wherein a cross-section of the enclosed compressible cavity traverses uninterrupted between the first peg and the second peg.

2. The fan mounting system of claim 1, wherein the fan housing defines a third opening and a fourth opening, the chassis includes a second receiving opening, and the fan mounting system further includes a second fan mount including a third peg engaged with the third opening and a fourth peg engaged with the fourth opening and a pin engaged with the second receiving opening.

3. The fan mounting system of claim 1, wherein the fan housing is secured along an axis substantially perpendicular to a plane of the chassis.

4. The fan mounting system of claim 1, wherein the fan mount includes a front port and a rear port and wherein the compressible cavity connects the front port and the rear port.

5. The fan mounting system of claim 4, wherein the first end opposes the second end, and wherein the first and second ends are each arranged to move toward the cavity toward the other of the first and second ends.

6. The fan mounting system of claim 5, wherein the first peg is disengaged from the first opening when one of the first and second ends moves toward the other of the first and second ends.

7. The fan mounting system of claim 1, further comprising a pin extending into the receiving opening of the chassis and disengageable from the receiving opening, wherein the pin includes a conical portion that is deformably insertable into the receiving opening.

8. The fan mounting system of claim 7, wherein the pin includes a narrow portion, the conical portion disposed beneath the receiving opening and the narrow portion disposed in the receiving opening when the pin is fully inserted into the receiving opening.

9. The fan mounting system of claim 7, wherein the conical portion includes a top portion having a first diameter greater than a second diameter of the receiving opening.

10. The fan mounting system of claim 1, wherein the fan mount includes an inclined side in contact with the fan housing.

11. The fan mounting system of claim 1, wherein the fan housing includes a first wall and a second wall, the first and second walls defining a mount opening.

12. The fan mount of claim 1, wherein the enclosed compressible cavity comprises at least two front ports and at least two rear ports, wherein the enclosed compressible cavity connects the at least two front ports and the at least two rear ports.

13. A fan mount, comprising:

an enclosed compressible cavity, wherein the enclosed compressible cavity comprises a first end, a second end, a bottom side, a top side, and a front side, and wherein a first pee is attached to the first end of the enclosed compressible cavity and a second peg is attached to the second end of the enclosed compressible cavity and wherein a cross-section of the enclosed compressible cavity traverses uninterrupted between the first peg and the second peg; and a pin extending from the bottom side.

14. The fan mount of claim 13, wherein the first end is opposite the second end.

15. The fan mount of claim 13, wherein the pin includes a narrow portion attached to the bottom side and a conical portion attached to the narrow portion.

16. The fan mount of claim 15, wherein the conical portion includes a top portion having a diameter greater than a diameter of the narrow portion.

17. The fan mount of claim 15, wherein the pin defines a pin opening extending from the conical portion to the narrow portion.

18. The fan mount of claim 13, further comprising a front port disposed on the front side, a rear port disposed on a rear side, wherein the compressible cavity connects the front port to the rear port.

19. The fan mount of claim 13, wherein the first and second ends are each arranged to move toward the other of the first and second ends.

20. The fan mount of claim 13, wherein the first peg is arranged to engage a first opening and the second peg is arranged to engage a second opening in a fan housing.

* * * * *